United States Patent [19]

Davis

[11] 4,336,289

[45] Jun. 22, 1982

[54] PRODUCT AND METHOD OF FORMING PATTERNED AREAS IN A PILE RUG

[76] Inventor: Edward L. Davis, 1087 Bailey Ave., Chattanooga, Tenn. 37404

[21] Appl. No.: 280,863

[22] Filed: Jul. 6, 1981

[51] Int. Cl.[3] ..... B32B 35/00; C09J 5/00

[52] U.S. Cl. ..... 428/67; 156/72; 156/98; 156/254; 156/259; 156/263; 156/264; 156/265; 156/267; 156/285; 156/293; 156/297; 156/298; 428/63; 428/77; 428/78; 428/79; 428/82; 428/86; 428/88; 428/89; 428/190

[58] Field of Search ..... 428/63, 82, 86, 88, 428/89, 77, 78, 79, 190, 67; 156/72, 98, 254, 259, 263, 264, 265, 267, 285, 293, 297, 298

[56] References Cited

U.S. PATENT DOCUMENTS 3,703,424 11/1972 Charnock ..... 428/88

4,058,423 11/1977 Bascom ..... 428/63

*Primary Examiner*—Marion McCamish

*Attorney, Agent, or Firm*—Harrington A. Lackey

[57] ABSTRACT

A product and method for making a patterned area in a pile rug in which pile yarn is carved out and removed to form a trough-like area, and one or more fabric pattern pieces having a total area and shape coinciding with the carved out trough-like area is inserted into the trough-like area and adhesively bonded in place. The top surface of the fabric pattern piece is distinct in either color, texture, material, or pattern from the main pile surface to produce contrasting patterns in the surface of the rug. The fabric pattern piece may be a separate pile strip including its own base fabric and pile yarn of different color, texture, material, height, or other distinguishing characteristics from the pile yarn of the main body of the rug. The method is particularly adapted for forming linear patterned insert pieces along the borders of an area pile rug.

11 Claims, 14 Drawing Figures

PRODUCT AND METHOD OF FORMING PATTERNED AREAS IN A PILE RUG

BACKGROUND OF THE INVENTION

This invention relates to a product and method of decorating rugs, and more particularly to a method of forming distinct patterned areas in a pile rug.

There are numerous methods and apparatus for forming patterned rugs or carpets, woven or tufted, of different designs in which various areas of the rug have different characteristics. Different colored patterns may be formed in pile rugs by utilizing different colored yarns in different areas. Special looms with Jacquard or Dobby attachments, or tufting machines with pattern drums or other types of pattern controls, may be utilized for forming pile rugs having different patterns, distinguished by color, texture, pile height, yarn material, cut or uncut loops, or other characteristics. Different colored patterns may be formed on finished woven or tufted pile carpets by printing different colored designs upon the pile surface.

In one specialized method of making rugs having different pattern areas, and more particularly for forming a border on an area pile carpet, a rug is trimmed to form a central rug area of the desired dimensions. The borders to this central rug area are formed by cutting longitudinal strips from other carpeting having the desired pile characteristics, such as a different colored pile yarn. The edges of the border strips, cut to the desired length and width, are then laid against the corresponding edges of the central rug area. The abutting edges of the respective rug pieces are then seamed together, preferably by overlapping seaming strips, and also secured in abutting relationship by the application of adhesive material, or by heat-sealing.

Although this process of fabricating bordered rugs produces the desired surface effect, nevertheless such rugs have limited life, since the abutting edges of the border strips and the central rug area tend to separate from each other, even though stitched, glued, and/or heat-sealed, after sufficient wear or stress has weakened the seams and/or adhesive material joining the abutting edges of the base fabrics of the border strip and central rug area.

The contrasting effects of the numerous border designs produced by this method are not easily reproduced by other known methods of making patterned pile fabrics or rugs, yet the appeal of such patterned bordered rugs is diminished by the brevity of their service life.

SUMMARY OF THE INVENTION

It is therefore an object of this invention to provide a product and method of fabricating patterned areas of different designs in a pile rug, and particularly the border designs for area type pile carpets.

In the preferred method of making such patterned areas, an existing pile carpet, either woven or tufted, is selected having the basic yarn characteristics of the desired main rug area, such as the desired color, texture, yarn material, pile density, etc. The area of the rug in which the contrasting pattern is desired, such as a contrasting border, is selected, and the pile yarns lying in this predetermined pattern area are removed by carrying out the undesired pile yarn by shearing to a depth substantially equal to the pile height. The undesired pile yarn may be removed by suction, such as by a vacuum hose. Templates may be employed for defining the pattern area and to guide the shearing tools so that only the yarns in the pattern area are sheared.

One or more pattern pieces, such as other pile fabric pieces including their own base fabrics and projecting pile yarns, are selected and cut or trimmed so that they will fit the carved out trough-like areas in the main rug area. These pattern pieces, particularly if they are pile pieces, are preferably cleaned, steam-treated and bevelled along their top side edges, if desired. An adhesive material or coating, such as latex or animal glue is then applied preferably to the bottom surface of the pattern piece or pieces. The pattern is then inserted into the trough-like area so that the adhesive material will bond the bottom surfaces of the inserted pattern piece flush against the facing surface of the trough-like area, and preferably to the top surface of the underlying base fabric. The top surfaces of the fabric pieces, particularly if pile fabric inserts, may be further finished, such as by trimming or sculpturing, to produce not only an area pile carpet having distinct contrasting pattern areas, not easily achieved by other known methods of making patterned pile fabrics, but also such a carpet of substantial integrity and long-wearing qualities.

The pattern areas of such a carpet are, in fact, stronger because the entire bottom surfaces of the fabric inserts are reinforced by the base fabric portion of the main rug securely bonded to the fabric pattern piece. Moreover, the integrity of the base pile carpet is not destroyed or even affected, because its entire base fabric remains intact and unsevered throughout its width and length. Only portions of the pile yarns are removed in order to insert the fabric pattern pieces and the pile yarns themselves have little effect upon the strength, integrity, and stability of the overall rug. The weaknesses created by the prior art abutting edges of the pile carpets and border strips are completely obviated by the method of fabricating rugs having distinct pattern areas in accordance with this invention.

Furthermore, since the patterned fabric strips or pieces utilized in applicant's method do not have to conform in thickness and abutting relationship to the base fabric of the main carpet, the choice of pattern fabric pieces for achieving distinct design patterns is almost unlimited. In applicant's method, not only can pattern pieces, and particularly border strips be formed from various types of pile fabrics of different color, yarn characteristics, pile heights and even thicknesses, but other types of fabric pattern pieces than pile fabrics may also be utilized for insertion into the trough-like areas carved out in the main pile rug. Pattern fabric pieces, such as woven or embroidered fabrics of numerous types of material, may be bonded directly to the trough-like surfaces, or they may be wrapped about various types of core material for added body, thickness and strength and still be bonded in the trough-like area to produce remarkable decorative effects.

DESCRIPTION OF THE PREFERRED EMBODIMENTS

Figure 2:
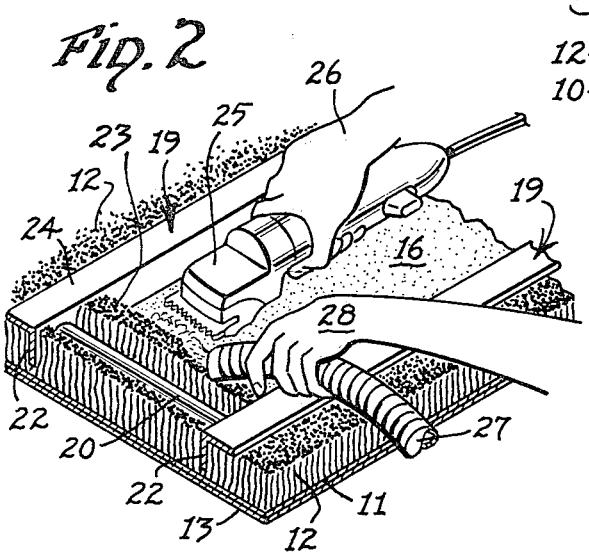
FIG. 2 is a greatly enlarged, fragmentary perspective view of a portion of the carpet, illustrating the steps of carving out the trough-like area and removing the clipped pile yarn portions.
Figure 1:
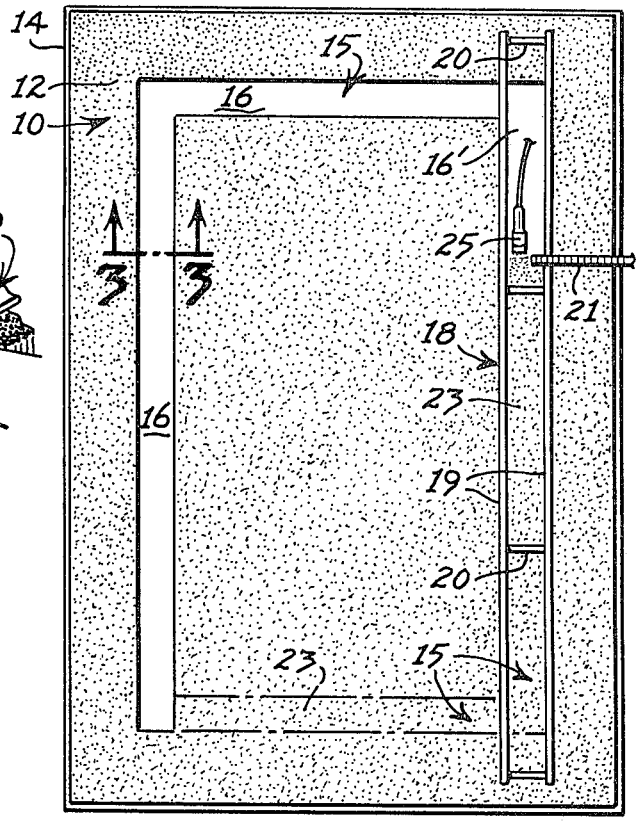
FIG. 1 is a top plan view of a rectangular area pile carpet, illustrating the first step of carving out a trough-like rectangular border area.
Figure 3:
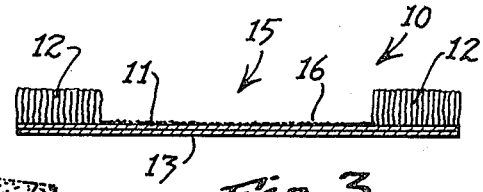
FIG. 3 is an enlarged fragmentary section taken along the line 3—3 of FIG. 1.

Referring now to the drawings in more detail, FIG. 1 discloses rectangular area pile carpet 10 of conventional construction, including a main base fabric 11 (FIGS. 2 and 3). A plurality of cut pile yarns 12, disclosed as being of uniform color, height, material and other characteristics, project upward from the main base fabric 11 to form the main rug area. The bottom surface of the base fabric 11 is covered by a bottom cover fabric or a latex coating 13, in a conventional manner, to provide a wear-resistant, non-skid surface for the rug when it lies on the floor of a room. The carpet 10 may also be seamed with a border strip 14.

After the pile carpet 10 is obtained having the desired yarn characteristics for the main rug area 12, a design and location for the pattern area 15 on the rug 10 is determined. As disclosed in FIGS. 1–10, pattern area 15 is a rectangular inner border strip of uniform width, having its sides and ends parallel to the corresponding sides and ends of the carpet 10, and forming a uniform outer border area of the existing pile yarns 12, also of uniform width from the border 14.

After the rectangular pattern area 15 is selected, the longitudinal pattern area strips are carved out to form corresponding trough-like areas or surfaces 16.

In order to form the particular trough-like areas 16, a template 18 having a pair of longitudinal guide bars 19 spaced apart the same distance as the width of the pattern areas 15, may be laid in a position upon the carpet 10 coincident with each desired pattern area strip 15. The longitudinal guide bars 19 may be held in spaced relation by the longitudinally spaced transverse spacer bars 20. The template 18 may be finely adjusted to overly the respective longitudinal pattern area 15 by means of a threaded adjustment screw 21, which is secured to a fixed frame, not shown, adjacent the carpet 10.

The longitudinal guide bars 19 may be in the form of elongated angle bars, as illustrated in FIG. 2, with the vertical flange 22 of each angle bar 19 forming an inner wall adapted to descend between the pile yarns to separate the pile yarns 23 desired to be cut and the main pile yarns 12 which are to remain standing.

The horizontal flange 24 of each guide bar 19 provides a lip to prevent the adjacent pile yarns 12 from extending into the pattern area 15, where they might be inadvertently sheared or clipped.

After the template 18 is securely located in position, for example parallel to one longitudinal side of the carpet 10, as illustrated in FIG. 1, to coincide with the corresponding pattern area 15, all of the pile yarn 23 within the pattern area 15, that is between the guide bars 19, is carved out, sheared, or clipped by any convenient mechanism, such as the electrical shears 25, illustrated in FIGS. 1 and 2, held in the hand 26 of the operator. As the shears 25 are moved along the template 18 between the guide bars 19, the cut end portions of the pile yarns 23 are preferably removed immediately after they are cut, by a suction device, not shown, creating a vacuum through a suction hose 27 held in the other hand 28 of the operator.

After each length of the pattern area or strip 15 is completely carved out by the shears 25, the template 18 is moved to a different location, that is over another leg or strip of the rectangular pattern area 15, and the process is repeated until all four strips of the rectangular pattern area have been carved out to form the rectangular trough-like area 16.

As disclosed in FIG. 1, the upper end and left side strips of the pattern area 15 have already been carved out to form the completed trough-like areas 16. The template 18 is disclosed aligned with the right-hand strip of the pattern area 15 and illustrates the trough-like area 16' as already having been carved out, while the remaining pile yarn 23 in the pattern area 15 is still standing, but will be subsequently sheared. A better view of the outline of the carved out trough-like area 16 is disclosed in the enlarged cross-sectional view in FIG. 3.

The carved out trough-like pattern areas 16 are now ready to receive corresponding lengths or strips of patterned fabric pieces of any one of numerous designs. One example of a pile fabric pattern piece 30 is illustrated in FIGS. 4–10. This pile pattern piece 30 includes an elongated base fabric strip 31 having cut pile pattern yarns 32 projecting upward therefrom. The bottom of the base fabric 31 is covered by a bottom fabric cover or a coating material, such as 33. The pattern pile yarns 32 are illustrated as being of uniform density and uniform characteristics, including uniform pile height, and are preferably of a uniform color, different from the color of the pile yarns 12 and 23 in the main carpet 10. As illustrated in the drawings, the cut pile yarns 32 are formed by a tufting process.

Figure 4:
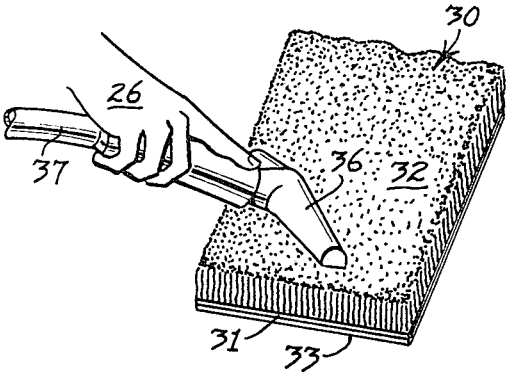
FIG. 4 is a fragmentary perspective view of a portion of a pile pattern piece being treated with steam.

The pattern piece 30 is cut in lengths and widths to fit within the corresponding trough-like areas or strips 16. The ends of the pattern strips are preferably cut to form the 45° miter joints 35, illustrated in FIG. 9. After the pattern pieces 30 are selected to size, they may be cleaned and steam-treated by a steaming device including a steaming head 36 attached to a steam hose 37, and manipulated by the hand 26 of the operator to steam-treat the pile yarns 32, as illustrated in FIG. 4.

Figure 5:
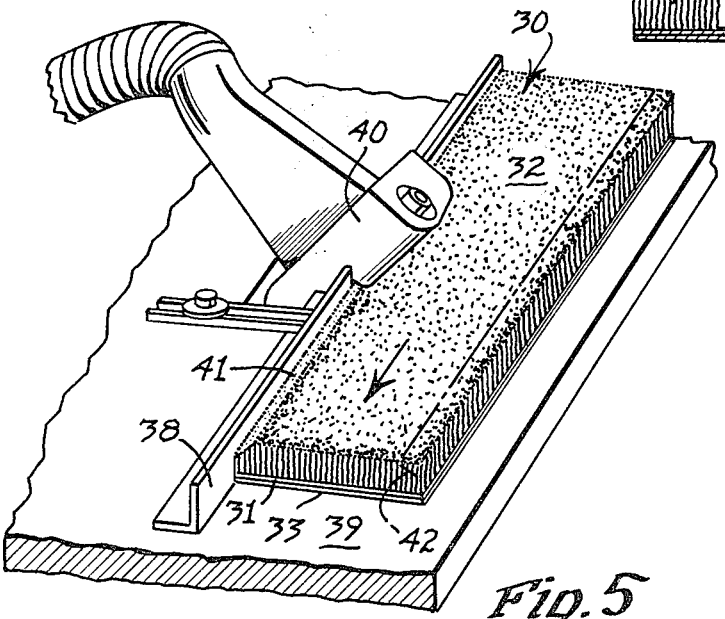
FIG. 5 is an enlarged fragmentary perspective view of a portion of a pile pattern piece, illustrating the step of shearing bevelled surfaces upon the top side edges of the pile pattern piece.
Figure 6:
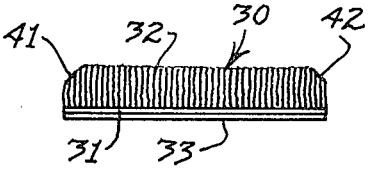
FIG. 6 is a cross-sectional view of a pile pattern piece after its top side edges have been bevelled.

Then, if desired, the pile pattern piece 30 may have its top longitudinal side edges bevelled by moving the pattern piece 30 along an elongated guide member 38 fixed on a table 39 and upon which is supported a bevelling shear head 40, with its shear blade set at a 45° angle to form the bevelled shear surfaces 41 and 42, illustrated in FIGS. 5 and 6, for decorative purposes.

Figure 7:
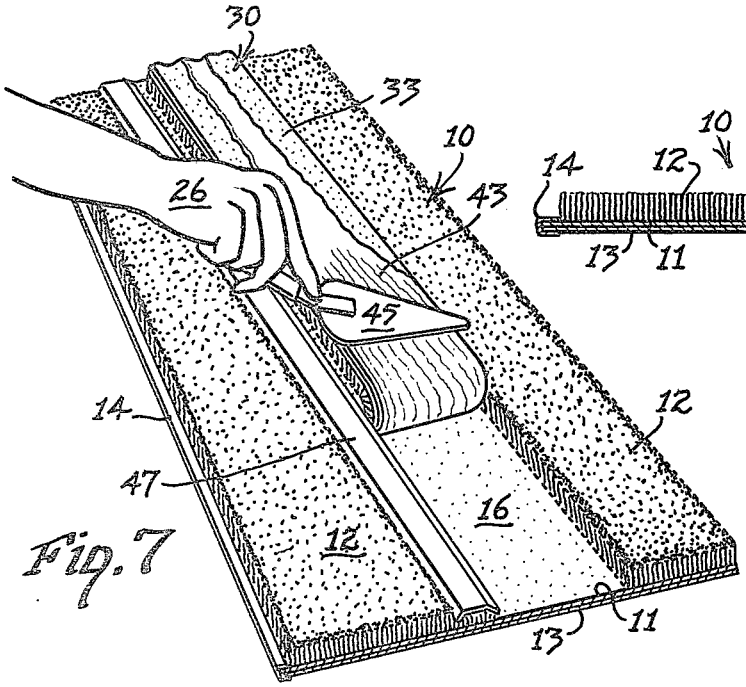
FIG. 7 is a fragmentary top perspective view of a portion of the pile rug, illustrating the step of applying adhesive material to the pattern piece and inserting the pattern piece into the trough-like area of the pile rug.

The finished pattern piece 30 may then be turned upside down, and an adhesive material or coating 43, such as latex or animal glude, is spread upon the back surface of the back cover 33 of the fabric piece 30, by any convenient means, such as manually by a trowel 45 manipulated by the hand 26 of the operator, as best disclosed in FIG. 7. The pattern piece 30 with the adhesive coating 43 on the back thereof, may be laid in the trough-like area 16, as illustrated in FIG. 7, a portion at a time. The pattern piece 30 may be folded back upon itself while the remaining back surface 44 is coated with the adhesive 43. The fabric pattern piece 30 is then sequentially folded over until the entire back surface 44, coated with the adhesive material 43, is firmly seated and bonded to the trough-like surface 16. This process is repeated for each of the pattern fabric strips 30 until all of the trough-like surfaces 16 are fitted with the respective pattern strips 30, and the carpet 10 has the appearance of the border design illustrated in FIG. 9.

Figure 10:
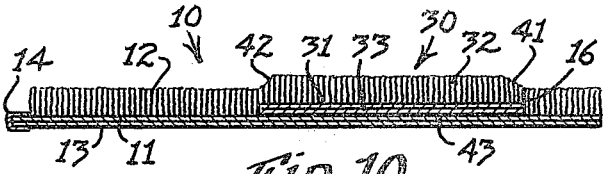
FIG. 10 is an enlarged fragmentary section taken along the line 10—10 of FIG. 9.
Figure 9:
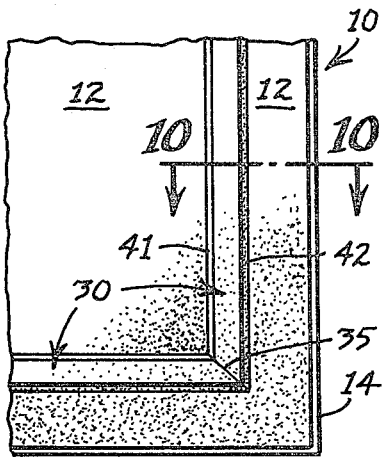
FIG. 9 is a fragmentary top plan view of one corner of a finished area pile rug in which the linear pile pattern pieces have been inserted to form a decorative border.

As illustrated in FIG. 10, the pattern pile yarns 32 project above the pile yarns 12 of the main body of the carpet 10, and the edges of the fabric strip 30 adjacent the pile surface 12 are relieved by the bevelled surfaces 41 and 42.

Of course, if desired, the height of the pile yarns 32 could be equal to the height of the pile yarns 12, or the pile yarns 32 could be lower to form an inset relief border.

Figure 8:
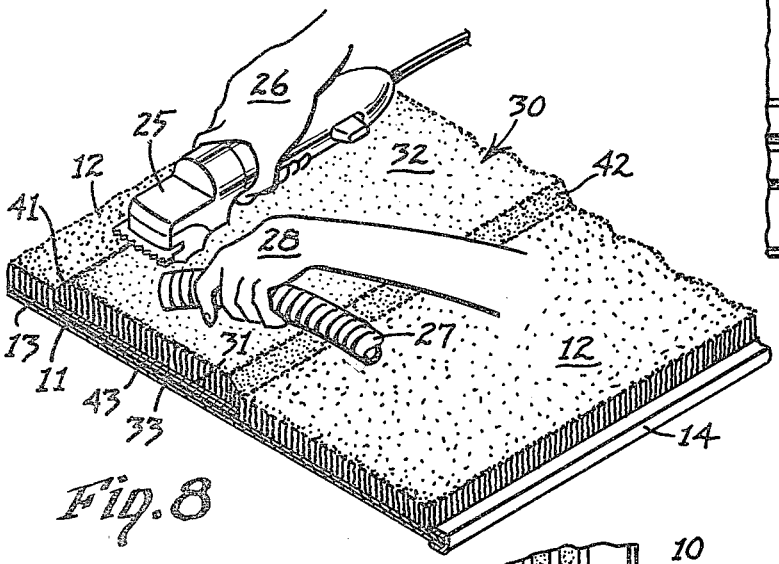
FIG. 8 is a fragmentary top perspective view of the pattern piece inserted into a portion of the rug and illustrating the finishing step of shearing the pile surface of the pattern piece.

After the pattern fabric pieces 30 are securely bonded in place in the respective trough-like portions 16, the pile yarns 32 may be further treated by clipping, shearing or carving with the shears 25 and the clipped yarns removed by the vacuum hose 27, as illustrated in FIG. 8.

Also, as illustrated in FIG. 7, an elongated rigid insert guide 47 may be fitted along one edge of the trough-like area 16 to facilitate the fitting and insertion of the pattern piece 30 in the trough-like area 16.

Figure 11:
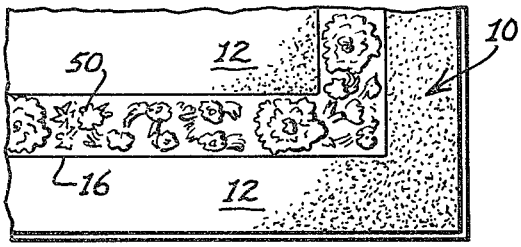
FIG. 11 is a view similar to FIG. 9 in which a non-pile fabric decorative pattern piece has been inserted into a pile rug to form a border design.

In FIG. 11, the same process utilized in the fabrication of the pattern pieces 30 in the carpet 10 is also utilized in inserting a different non-pile pattern fabric piece 50 in the carpet 10, as illustrated in FIG. 11. The pattern piece 50 may be formed of strips of woven material incorporating embossed or embroidered designs, which are secured by the same type of adhesive material, not shown, in the trough-like pattern area 16.

Figure 12:
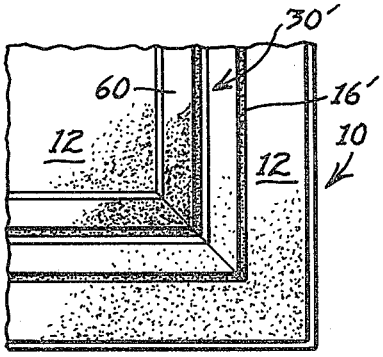
FIG. 12 is another view similar to FIG. 9 in which the rug incorporates a pair of adjacent pile fabric pattern pieces to form another border design.

In FIG. 12, the same process of inserting pattern fabric pieces is utilized in inserting two inset pile fabric border pieces 30' and 60 in the trough-like area strips 16' differing from the trough-like area 16 in width only.

Figure 13:
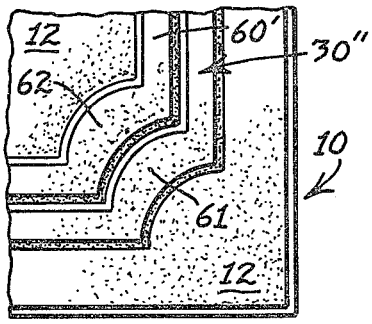
FIG. 13 is a view similar to FIG. 12 illustrating a pair of pile fabric pattern pieces of a different design.

FIG. 13 discloses a carpet 10 having the same design as that disclosed in FIG. 12, differing only in the shape of the corners of the intersecting strips. The first or outer inset strips 30'' are provided with arcuate corner pieces 61, while the second or inner inset pattern border strips 60' include a corresponding curved corner strip 62.

Figure 14:
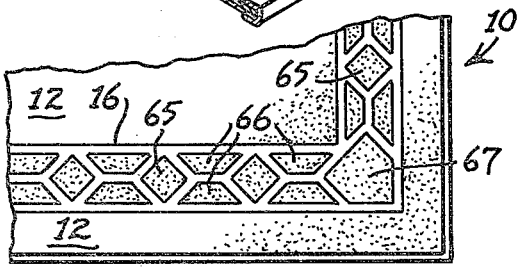
FIG. 14 is a view similar to FIG. 9 in which the rectangular trough-like area has been filled with a plurality of discrete pile pattern pieces to form a more intricate border design.

In FIG. 14, the same trough-like pattern area 16 is filled with, instead of single elongated strips 30, a plurality of discrete pieces of pile fabric 65, 66, and 67 to form the intricate border design illustrated in FIG. 14.

The carpet pattern designs illustrated in FIGS. 9 and 11–14 are only a few of the limitless number of possible design patterns, which can be incorporated as distinctive pattern pieces adhered in the carved-out trough-like portion of a conventional pile carpet.

FIG. 10 best illustrates the construction of the inserted fabric piece 30 within the carved-out portion of the main body of the main carpet 10. It will be noted that the fabric pattern piece 30 is not only supported by its own base fabric 31 but also by the base fabric 11 of the main carpet body to which it is firmly adhered by the layer of adhesive material 43. Not only is the pattern fabric piece 30 reinforced by the main body of the carpet 10, but the main body of the carpet 10 is reinforced by the pattern fabric strips 30 to provide long service life for a pile carpet capable of intricate designs.

What is claimed is:

1. A method of making patterned areas of different designs in a pile rug including a base fabric and pile yarns projecting from one side of the base fabric to form a pile surface, comprising the steps of:

(a) carving out from a predetermined area of the pile rug, portions of the pile yarn in said area, to form a trough-like surface of reduced pile height in said area, (b) forming at least one fabric pattern piece having a top surface and a bottom surface, whose total shape and area is substantially equal to the predetermined area of said trough-like surface, (c) applying an adhesive material to the bottom surface of said fabric pattern piece, and (d) inserting said pattern piece upon said trough-like surface so that said pattern piece fits said corresponding trough-like area, said adhesive material bonds the bottom surface of said pattern piece to said trough-like area, and the top surface of said pattern piece is exposed to view in design contrast with the uncarved pile surfaces of the pile rug.

2. The method according to claim 1 further comprising the step of laying templates upon the pile surface before said carving step to define said predetermined area and to prevent carving of any pile surface outside said predetermined area.

3. The method according to claim 1 in which said carving step comprises shearing said pile yarn in said predetermined area and removing by suction the sheared pile yarn portions from said trough-like surface.

4. The method according to claim 3 in which said shearing comprises clipping said pile yarn closely adjacent said one side of said base fabric.

5. The method according to claim 1 in which said fabric pattern piece comprises a base fabric piece having said bottom surface, and pile yarns projecting from said base fabric piece to define said top surface, the pile yarns of said fabric piece being distinct from the pile yarns of said pile rug.

6. The method according to claim 5 further comprising the step of shearing the top side edges of the pattern piece of pile yarn to form bevelled pile surfaces.

7. The method according to claim 1 in which said trough-like surface is elongated and of substantially uniform width and said pattern piece is substantially the same length and width as said trough-like surface.

8. The method according to claim 7 in which said pattern piece inserted in said trough-like surface forms a border design in said pile rug.

9. A pattern pile rug comprising:

(a) a main base fabric having a bottom surface and a top surface, (b) pile yarn projecting upward from said main base fabric to form a main pile surface, (c) a trough-like area formed in said main pile surface above said main base fabric, (d) at least one fabric pattern piece having a top surface and a bottom surface, whose total shape and area is substantially equal to said trough-like area, said pattern piece being received in said trough-like area, and (e) adhesive means bonding the bottom surface of said pattern piece to the surface of said trough-like area.

10. The invention according to claim 9 in which said fabric pattern piece comprises a base fabric piece including the bottom surface of said pattern piece and a plurality of pattern pile yarns projecting upward from said base fabric piece to define the top surface of said fabric pattern piece, said pattern pile yarns being distinct from the pile yarns in said main pile surface.

11. The invention according to claim 9 in which said adhesive means bonds the bottom surface of said pattern piece to the top surface of said main base fabric.

* * * * *